US008438826B2

(12) United States Patent
Pourladian et al.

(10) Patent No.: US 8,438,826 B2
(45) Date of Patent: May 14, 2013

(54) FOUR STRAND BLACKENED WIRE ROPE

(75) Inventors: Bamdad Pourladian, Saint Joseph, MO (US); Timothy W. Klein, Savannah, MO (US)

(73) Assignee: WireCo WorldGroup Inc., Kansas City, MO (US)

( * ) Notice: Subject to any disclaimer, the term of this patent is extended or adjusted under 35 U.S.C. 154(b) by 177 days.

(21) Appl. No.: 12/901,655

(22) Filed: Oct. 11, 2010

(65) Prior Publication Data

US 2012/0085077 A1 Apr. 12, 2012

(51) Int. Cl.
*D07B 1/00* (2006.01)

(52) U.S. Cl.
USPC ..... 57/237; 57/241

(58) Field of Classification Search ..... 57/211, 57/212, 213, 217, 223, 230, 232, 236, 241, 57/258, 237
See application file for complete search history.

(56) References Cited

U.S. PATENT DOCUMENTS

| | | | | |
|---|---|---|---|---|
| 2,384,038 | A | 9/1945 | Larkin | |
| 2,956,017 | A | 10/1960 | Franks | |
| 3,374,619 | A | 3/1968 | Adams et al. | |
| 3,395,528 | A | 8/1968 | Lucht | |
| 3,600,884 | A | 8/1971 | Yazawa et al. | |
| 3,778,994 | A | 12/1973 | Humphries | |
| 3,816,185 | A | 6/1974 | Toledo et al. | |
| 3,834,149 | A | 9/1974 | Nisbet | |
| 3,942,309 | A | 3/1976 | Cahill | |
| 4,106,276 | A | 8/1978 | Hosoya | |
| 4,365,467 | A | 12/1982 | Pellow | |
| 4,487,010 | A | 12/1984 | Chiappetta et al. | |
| 4,509,319 | A | 4/1985 | Yoshida et al. | |
| 4,651,513 | A | 3/1987 | Dambre | |
| 5,282,377 | A | 2/1994 | Illig et al. | |
| 5,475,973 | A | 12/1995 | Furukawa et al. | |
| 5,554,826 | A * | 9/1996 | Gentry | 174/128.1 |
| 6,260,343 | B1 | 7/2001 | Pourladian | |
| 6,276,120 | B1 * | 8/2001 | Adriaensen et al. | 57/210 |

(Continued)

FOREIGN PATENT DOCUMENTS

JP 2003-160880 A 6/2003

OTHER PUBLICATIONS

Black Oxide Project: Full Interview with ZFX Shop Foreman Dylan Lightfoot, http://www.zfxflying.com/ newsletters/Black% 20Oxide%20 Interview,%20 Septemeber% 202007.pdf, Sep. 7, 2007.

Rotation-resistant and low-torque ropes, Union A WireCo WorldGroup Brand brochure, published in 2008, exact month and day of publication unknown, pp. 14-17.

*Primary Examiner* — Shaun R Hurley
(74) *Attorney, Agent, or Firm* — Husch Blackwell LLP

(57) ABSTRACT

The present invention is directed to a wire rope having a blackened finish designed for theatrical productions. The wire rope includes a plurality of strands that have a closed spiral arrangement with each other and are compacted. Each strand includes a center wire spirally surrounded by a plurality of inner wires that are spirally surrounded by a plurality of outer wires so that the outer wires completely encompass the inner wires. The center wire and the inner wires are made from a galvanized material and coated with a lubricant. The outer wires are made from a non-coated steel material. Each strand is compacted so the outer wires create a tight mechanical seal to protect the inner wires. The blackened finish on the wire rope is due to a black oxide coating treatment and provides for low visibility of the wire rope during theatrical performances.

20 Claims, 4 Drawing Sheets

U.S. PATENT DOCUMENTS

| | | | | |
|---|---|---|---|---|
| 6,327,841 | B1 | 12/2001 | Bertini et al. | |
| 6,339,920 | B1 | 1/2002 | Yokoyama | |
| 6,920,745 | B2 | 7/2005 | Bruyneel et al. | |
| 7,272,921 | B2 | 9/2007 | Misrachi | |
| 7,565,791 | B2 | 7/2009 | Itaya | |
| 7,585,562 | B2 | 9/2009 | Hasui et al. | |
| 2003/0110583 | A1* | 6/2003 | Stubler et al. | 14/22 |
| 2003/0226347 | A1* | 12/2003 | Smith et al. | 57/210 |
| 2006/0213175 | A1* | 9/2006 | Smith et al. | 57/237 |
| 2006/0279821 | A1* | 12/2006 | Riley et al. | 359/15 |
| 2007/0261387 | A1* | 11/2007 | Maybeck | 60/272 |

* cited by examiner

FOUR STRAND BLACKENED WIRE ROPE

CROSS-REFERENCE TO RELATED APPLICATIONS

None.

BACKGROUND OF THE INVENTION

Traditionally, theater production companies use 7×19 or 19×7 wire ropes for stage rigging applications to move actors around the stage. Such wire ropes are usually bright and reflect light so theater production companies or rope manufacturers will often coat the bright wire ropes with black powder to prevent the audience from easily detecting the ropes when used on performers. However, coating the rope with black powder often results in the black powder flaking off during the operation of the rope in the rigging system of pulleys and blocks commonly used in theater productions. Therefore, it would be beneficial to produce a wire rope for use in theatrical productions that has a blackened finish that will not wear or flake off during normal use of the ropes.

Traditional 7×19 or 19×7 wire ropes tend to rotate when under a tensile load which can result in dangerous conditions for performers. A "birdcage" failure of wire rope occurs when the outer strands of a rope balloon outwards taking the shape of a birdcage. This is sometimes due to shock loading. This birdcage effect exposes the core of the wire rope or allows it to pop or move out of position which can be dangerous for the performers. In addition, traditional ropes are subject to excessive rotation thereby rendering them unsuitable for use with swivels attached to the ends of the rope. Such swivels are often used in single part lifts in theatrical productions. Therefore, it would be beneficial to produce a birdcage-resistant and/or a rotation-resistant rope for use in theatrical productions.

Finally, in most theatrical productions, the actors wear elaborate and expensive costumes. If any kind of lubricant is added to the wire rope, the lubricants can rub off and ruin the costumes. However, wire rope will rust rapidly if not lubricated and, in turn, cause premature fatigue failure. Therefore, it would be beneficial to produce a non-lubricated wire rope that will not rust rapidly.

SUMMARY OF THE INVENTION

The present invention is directed to a wire rope having a blackened finish designed for theatrical productions. The wire rope includes a plurality of strands that have a closed spiral arrangement with each other and are compacted. Each strand includes a center wire spirally surrounded by a plurality of inner wires that are spirally surrounded by a plurality of outer wires so that the outer wires completely encompass the inner wires. The center wire and the inner wires are made from a galvanized material and coated with a lubricant. The outer wires are made from a non-coated steel material. Each strand is compacted so the outer wires create a tight mechanical seal to protect the inner wires. The blackened finish on the wire rope is provided by a black oxide coating treatment and provides for low visibility of the wire rope during theatrical performances.

Other and further objects of the invention, together with the features of novelty appurtenant thereto, will appear in the course of the following description. Certain embodiments of the invention are outlined above in order that the detailed description thereof may be better understood, and in order that the present contributions to the art may be better appreciated. In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

BRIEF DESCRIPTION OF THE SEVERAL VIEWS OF THE DRAWING

Further features of the present invention will become apparent to those skilled in the art to which the present invention relates from reading the following description with reference to the accompanying drawings, in which.

DETAILED DESCRIPTION OF THE INVENTION

Figure 1:
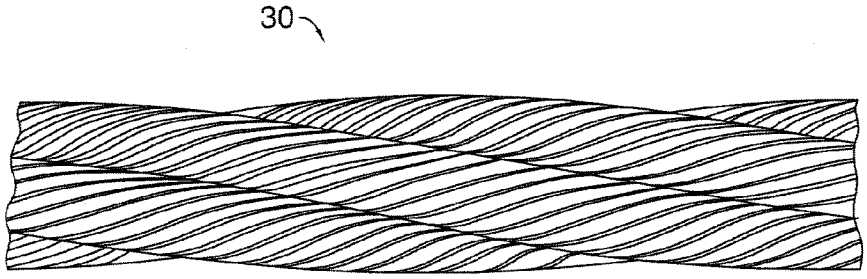
FIG. 1 is a side elevational view of one embodiment of the wire rope in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

A four-strand wire rope 30 embodying various features of the present invention is shown in FIG. 1. Rope 30 is ideal for use in theatrical stage rigging applications although one skilled in the art will appreciate that rope 30 may also be useful in other application including, but not limited to, mobile crane hoist rope, helicopter rescue hoist rope, marine mooring lines and marine towing lines. In one embodiment, rope 30 is constructed in a substantially rotation-resistant 4×31 configuration. One skilled in the art will appreciate that rope 30 may also be useful other configurations including, but not limited to, 4×19, 4×26, 4×36, 4×41, 4×49 and similar configurations. Rope 30 is coated with a blackened finish for low visibility during theatrical performances.

Figure 2:
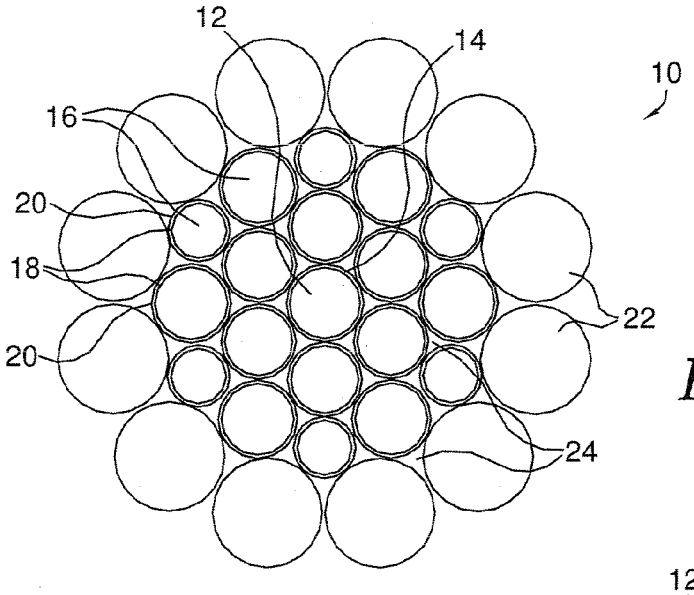
FIG. 2 is a cross-sectional view of one embodiment of a single strand used to construct the wire rope in accordance with one embodiment of the present invention.

In a first embodiment, shown in FIG. 2, a strand 10 includes a center wire 12 surrounded by eighteen inner wires 16. Center wire 12 and inner wires 16 are generally cylindrical and are constructed from high-carbon steel drawn to size galvanized wires which have a thin zinc coating. Rope 30 may have a diameter ranging from about ⅛ inch to ⅝ inch. Center wire 12 and inner wires 16 are drawn with a dry, solid lubricant 20, such as, for example, wax, molybdenum disulfide powder, graphite powder, boric acid powder, polytetrafluoroethylene tape or coating, and other appropriate lubricants. Lubricant 20 provides for internal lubrication between center wire 12 and inner wires 16, between inner wires 16, and between inner wires 16 and outer wires 22. Alternatively, center wire 12 and inner wires 16 may be constructed from corrosion-resistant materials or other appropriate materials that include a corrosion-resistant coating and then lubricant 20 is applied to an outer surface 14 of center wire 12 and to outer surfaces 18 of inner wires 16. Spaces 24 are located between center wire 12 and inner wires 16. As shown in FIG. 2, twelve outer wires 22 completely surround inner wires 16. Outer wires 22 are constructed from non-coated high-carbon steel. Center wire 12, inner wires 16, and outer wires 22 are used to produce strand 10 using a known stranding process. Once strand 10 is made, it is compacted using a known in-line compaction method. In one embodiment, stranding and compacting wires 12, 16 and 22 occurs simultaneously using known processes. Because rope 30 is often used to suspend performers wearing delicate and expensive costumes during theatrical performances, it is undesirable for outer wires 22 to contain any type of liquid or gel-like lubrication, as those types of lubrication can stain and ruin the costumes. Therefore, outer wires 22 that form rope 30 of the present invention are produced substantially without any liquid or gel-like lubrication. However, a lack of lubrication can cause premature red rust formation on wires 16. In order to substantially eliminate this problem, center wire 12 and inner wires 16 are made from drawn-galvanized high-carbon steel wires that have a thin zinc coating and are coated with lubricant 20. Additionally, lubricant 20 may be applied by baking it on the wires or spraying it on the wires and letting it dry at room temperature.

Figure 3:
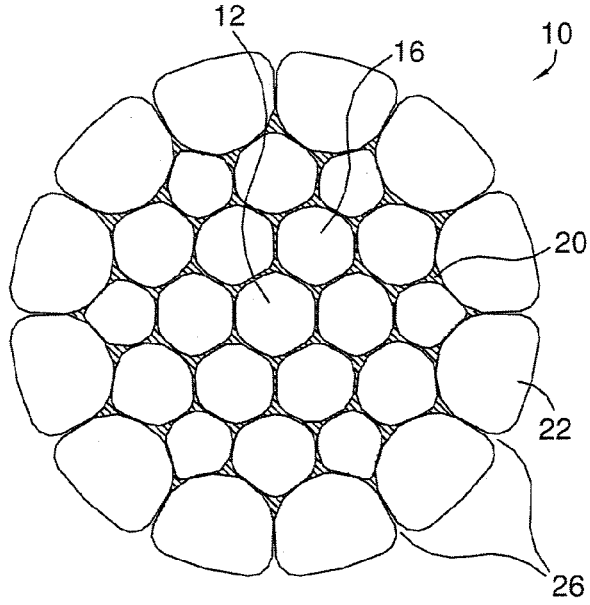
FIG. 3 is a cross-sectional view of the single strand of the wire rope of FIG. 1 after compaction in accordance with one embodiment of the present invention.

FIG. 3 illustrates strand 10 in a compacted state. The compaction of strand 10 flattens (plastically deforms and shapes) outer wires 22 in a manner that creates a mechanical seal 26 thereby creating a tight barrier so that liquids, chemicals or other gels cannot penetrate to inner wires 16. The compaction of strand 10 deforms center wire 12 and inner wires 16. Lubricant 20 is pressed in between and generally fills all of spaces 24 between center wire 12 and inner wires 16, between inner wires 16, and between inner wires 16 and outer wires 22.

Figure 4:
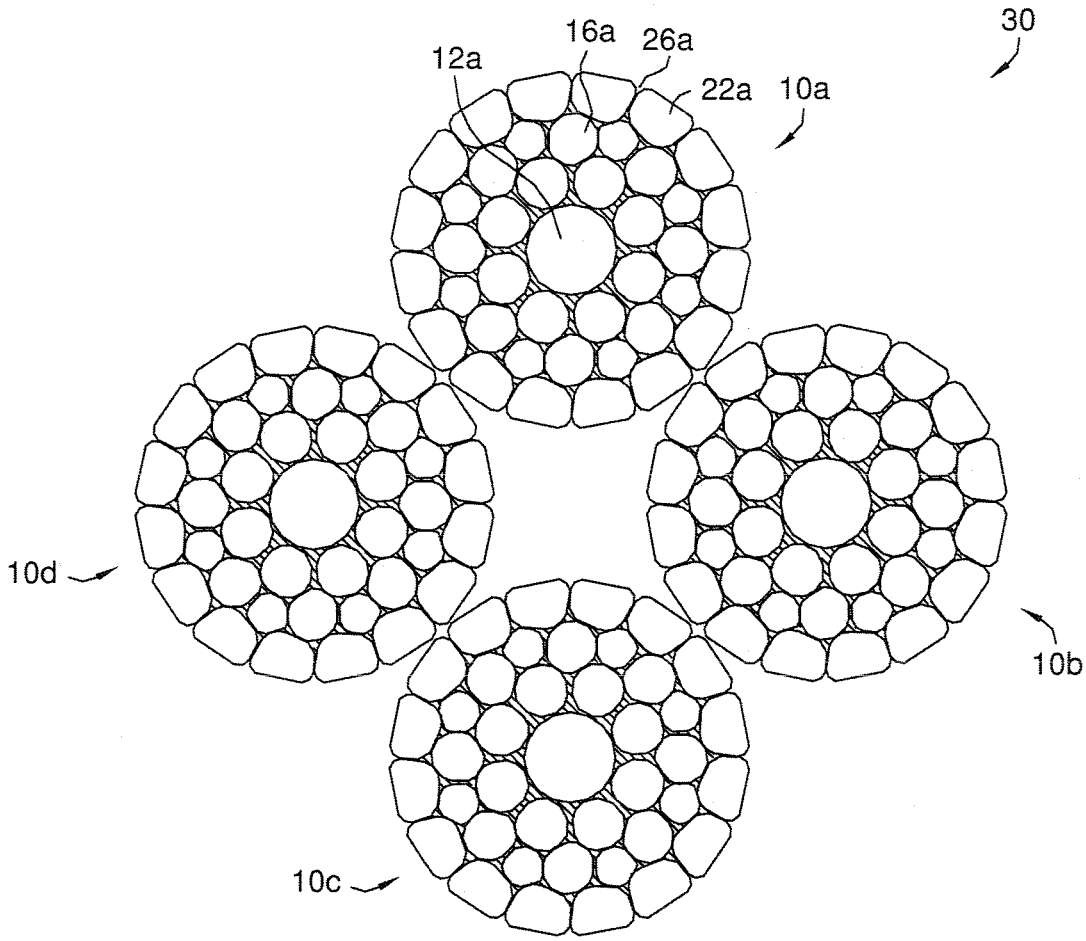
FIG. 4 is a cross-sectional view of four strands used to construct the entire wire rope in accordance with one embodiment of the present invention.
Figure 5:
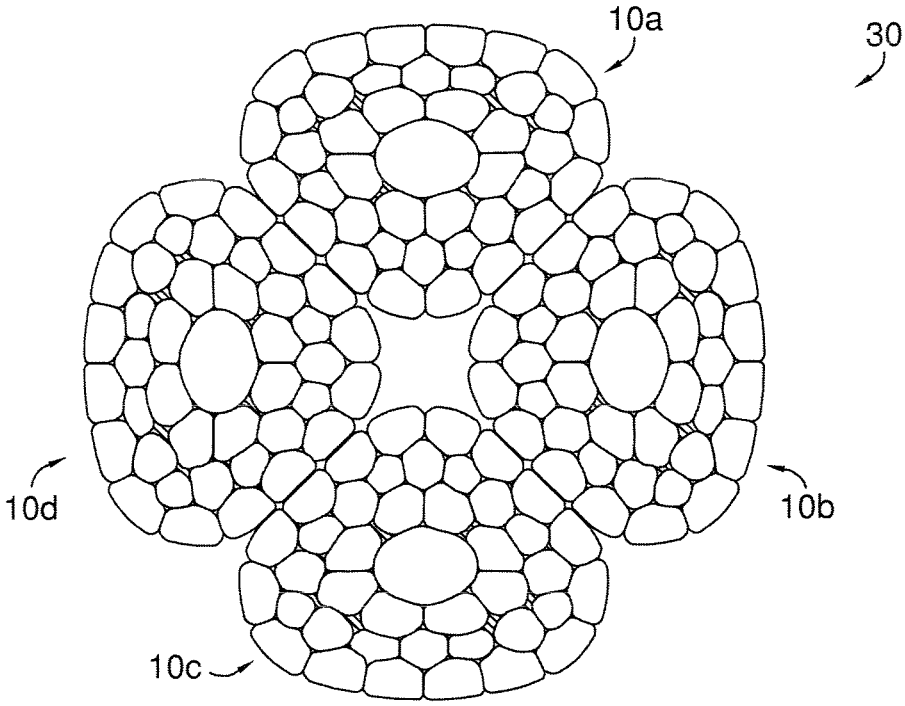
FIG. 5 is a cross-sectional view of the four strands of FIG. 3 after compaction in accordance with one embodiment of the present invention.

FIG. 4 illustrates an embodiment of rope 30 having four strands 10*a*, 10*b*, 10*c*, and 10*d* respectively and having a spiral arrangement. Strands 10*a*, 10*b*, 10*c*, and 10*d* include a center wire 12*a* surrounded by twenty-four (24) inner wires 16*a* surrounded by sixteen (16) outer wires 22*a*. Strands 10*a*, 10*b*, 10*c*, and 10*d* have been stranded and compacted and are closed together to produce rope 30. As shown in FIG. 4, when rope 30 is formed, the mechanical seal 26*a* formed by outer wires 22*a* of strand 10*a* is maintained. Rope 30 is rotation-resistant. In the embodiment illustrated in FIGS. 1-5, wire rope 30 is formed using four compacted strands. To produce rotation resistant wire ropes, a plurality of strands 10 are helically-laid around a center (not shown) that may be an additional wire or may be empty space as shown in FIGS. 4 and 5. It will be appreciated by one skilled in the art that wire rope 30 may comprise three, four or more strands arranged in a spiraled arrangement.

FIG. 5 illustrates rope 30 after compaction. Rope 30 undergoes a compaction process such as, for example, swaging or roller die compaction that further compacts rope 30. After compaction, rope 30 undergoes a black oxide coating treatment. Any black oxide coating method may be used, such as, for example, cold applied, low temperature, standard high temperature or other appropriate black oxide coating method now known or that may be known in the future. In order to eliminate the problem of flaking that can occur when the blackening is done through a powder coat treatment, the blackened finished of rope 30 occurs through a black oxide chemical conversion process. This process may be adversely affected if the black oxide chemical is contaminated by zinc contained in inner wires 16. Therefore, it is important that inner wires 16 containing zinc are not exposed to the chemicals used in the black oxide treatment. As described hereinabove, this is accomplished by first compacting each strand 10. The compaction of strand 10 causes the flattening (plastic deformation and shaping) of outer wires 22 and cause outer wires 22 to butt up (wedge) against one another thereby forming tight mechanical seal 26 and preventing the liquid black oxide chemical from coming into contact with inner wires 16. The blackened finish decreases the visibility of rope 30 for use in theatrical stage productions.

Figure 6:
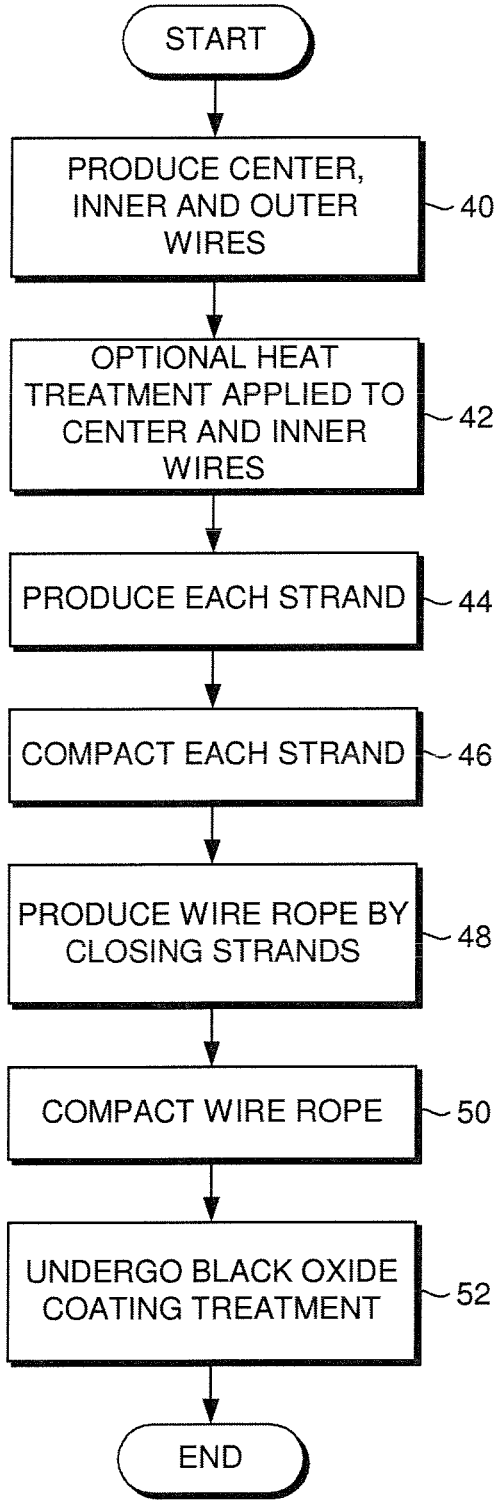
FIG. 6 is a flow diagram of a method of making the four strands and the entire wire rope in accordance with one embodiment of the present invention.

FIG. 6 is a flow diagram of one embodiment of the present invention of a method of making wire rope 30 where the individual configurations of wire rope 30 are illustrated in FIGS. 1-5. The method of producing wire rope 30 of the present invention involves several steps. In step 40, galvanized center wire 12 and inner wires 16 are produced and lubricant 20 is applied to outer surface 14 of center wire 12 and outer surfaces 18 of inner wires 16. In step 40, non-coated steel outer wires 22 are also produced. Step 42 is an optional heat treatment that may be applied to center wire 12 and inner wires 16 to both stress-relieve wires 12 and 16, and bake solid lubricant 18 to outer surface 14 of center wire 12 and outer surfaces 18 of inner wires 16. In step 44, center wire 12, eighteen inner wires 16 and twelve outer wires 22 are used to produce strand 10 in a normal stranding process. In step 46, each strand 10 is compacted using an in-line compaction method. The compaction of strand 10 flattens outer wires 22 in a manner were outer wires 22 provide mechanical seal 26 thereby creating a barrier so that the liquid chemicals used in step 52 in the blackening process cannot penetrate to inner wires 16 of strand 10. In step 48, wire rope 30 is produced by closing four strands 10*a*, 10*b*, 10*c*, and 10*d*. In step 50, wire rope 30 is compacted. In step 52, a blackened finish is applied to wire rope 30 by a black oxide conversion process in either an in-line process or a batch process.

The resultant wire rope 30 is a high-strength, rotation-resistant, birdcage-resistant, corrosion-resistant wire rope with a blackened finish that will not flake off during the operation of the rope in a rigging system of blocks and pulleys.

In an alternate embodiment that is not shown, standard end fittings can then be attached to the ends of wire rope 30 to produce various fabricated assemblies for use in stage rigging applications. Optionally, the end fittings can also be blackened as needed.

From the foregoing, it will be seen that this invention is one well adapted to attain all ends and objects hereinabove set forth together With the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A wire rope used for theatrical productions comprising:

a plurality of strands having a closed spiral arrangement with each other and being compacted, wherein each said strand includes a center wire spirally surrounded by a plurality of inner wires spirally surrounded by a plurality of outer wires, wherein said outer wires completely encompass said inner wires, wherein said center wire and said inner wires are made from a galvanized material and coated with a lubricant, wherein said outer wires are made from non-coated steel, and wherein each said strand is compacted so said outer wires create a tight mechanical seal that protects said inner wires; and a blackened finish on an outer surface of said outer wires wherein said blackened finish is produced by a black-oxide forming liquid chemical reacting with said non-coated steel of said outer wires.

2. The wire rope of claim 1 wherein said plurality of strands is four.

3. The wire rope of claim 1 wherein said lubricant is a solid that is baked or dried onto an outer surface of said inner wires.

4. The wire rope of claim 3 wherein said lubricant is selected from the group consisting of wax, molybdenum disulfide powder, graphite powder, polytetrafluoroethylene tape, polytetrafluoroethylene coating, and boric acid powder.

5. The wire rope of claim 1 wherein said lubricant is selected from the group consisting of wax, molybdenum disulfide powder, graphite powder, polytetrafluoroethylene tape, polytetrafluoroethylene coating, and boric acid powder.

6. The wire rope of claim 1 wherein a stress relieving heat treatment is applied to said center wire and said inner wires.

7. The wire rope of claim 1 wherein upon said compaction of said strand said lubricant flows into any space between said center wires and said inner wires.

8. The wire rope of claim 1 wherein said compaction is by a swaging process or a roller die compaction process.

9. The wire rope of claim 1 wherein said strand comprises said center wire, eighteen inner wires, and twelve outer wires.

10. The wire rope of claim 1 wherein said liquid chemical is selected from the group consisting of cold applied liquid, low temperature liquid, and high temperature liquid.

11. A wire rope used for theatrical productions comprising:

four strands having a closed spiral arrangement with each other and being compacted, wherein each said strand includes a center wire spirally surrounded by eighteen inner wires spirally surrounded by twelve outer wires, wherein said outer wires completely encompass said inner wires, wherein said center wire and said inner wires are made from a galvanized material and coated with a lubricant, wherein said outer wires are made from non-coated steel, and wherein each said strand is compacted so said outer wires are plastically deformed to create a tight mechanical seal that protects said inner wires from a black oxide coating liquid chemical; and a blackened finish on an exposed surface of said outer wires wherein said blackened finish is due to said wire rope being treated with a black oxide forming liquid chemical.

12. The wire rope of claim 11 wherein said lubricant is a solid that is baked or dried onto an outer surface of said inner wires and is selected from the group consisting of wax, molybdenum disulfide powder, graphite powder, polytetrafluoroethylene tape, polytetrafluoroethylene coating, boric acid powder.

13. The wire rope of claim 11 wherein a stress relieving heat treatment is applied to said center wire and said inner wires.

14. A method of producing a blackened wire rope for theatrical productions comprising the steps of:

producing a galvanized center wire;

producing a plurality of galvanized inner wires that surround said center wire;

applying a lubricant to said center wires and said inner wires;

producing a plurality of non-coated steel outer wires that completely surround said inner wires;

producing a strand by spirally arranging said inner and outer wires around said center wire;

compacting said strand using an in-line compaction method thereby creating a mechanical seal between said outer wires;

closing a plurality of said strands to produce said wire rope;

compacting said wire rope; and treating said compacted wire rope with a liquid chemical composition to produce a black-oxide layer on said non-coated steel outer wires resulting in a blackened finish on an exposed surface of said plurality of non-coated steel outer wires.

15. The method of claim 14 wherein said plurality of strands is four.

16. The method of claim 14 further comprising the step of applying a stress-relieving heat treatment to said center wire and said inner wires.

17. The method of claim 14 wherein said applying step is a process of baking or drying said lubricant onto an outer surface of said center wire and onto outer surfaces of said inner wires.

18. The method of claim 14 wherein said lubricant is selected from the group consisting of wax, molybdenum disulfide powder, graphite powder, polytetrafluoroethylene tape, polytetrafluoroethylene coating, and boric acid powder.

19. The method of claim 14 wherein said producing a strand step uses eighteen inner wires and twelve outer wires.

20. The method of claim 14 wherein said treating step includes a liquid chemical treatment selected from the group consisting of cold applied treatment, low temperature treatment, and high temperature treatment.

* * * * *